US011844395B2

(12) United States Patent
Howe et al.

(10) Patent No.: US 11,844,395 B2
(45) Date of Patent: Dec. 19, 2023

(54) SOLE STRUCTURE FOR AN ARTICLE OF FOOTWEAR

(71) Applicant: Under Armour, Inc., Baltimore, MD (US)

(72) Inventors: Justin Howe, Portland, OR (US); Amar Dhadwal, Portland, OR (US)

(73) Assignee: Under Armour, Inc., Baltimore, MD (US)

( * ) Notice: Subject to any disclaimer, the term of this patent is extended or adjusted under 35 U.S.C. 154(b) by 165 days.

(21) Appl. No.: 17/156,764

(22) Filed: Jan. 25, 2021

(65) Prior Publication Data

US 2021/0227926 A1 Jul. 29, 2021

Related U.S. Application Data

(60) Provisional application No. 62/964,880, filed on Jan. 23, 2020.

(51) Int. Cl.
*A43B 13/12* (2006.01)
*A43B 13/18* (2006.01)
*A43B 13/14* (2006.01)

(52) U.S. Cl.
CPC ..... *A43B 13/125* (2013.01); *A43B 13/141* (2013.01); *A43B 13/186* (2013.01)

(58) Field of Classification Search
CPC ... A43B 13/125; A43B 13/127; A43B 13/122; A43B 13/186; A43B 13/188; A43B 13/141; A43B 13/026; A43B 13/16; A43B 21/36; A43B 21/40; A43B 23/027; A43B 23/0275; A43B 3/26; A43B 5/1608; A43B 23/22; A43B 23/222; A43B 3/0036; A43B 3/0047; A43B 5/0445; A43C 15/08; A43C 11/12
USPC ..... 36/155, 160, 97, 107, 108
See application file for complete search history.

(56) References Cited

U.S. PATENT DOCUMENTS 5,611,152 A * 3/1997 Richard ..... A43B 13/12 36/27
5,737,855 A * 4/1998 Jordan ..... A43C 15/14 36/134
8,458,930 B2 * 6/2013 Ha ..... A43B 7/144 36/97
11,039,656 B2 * 6/2021 Norton ..... A43B 13/18
(Continued)

FOREIGN PATENT DOCUMENTS

KR 101538514 B1 * 7/2015 ..... A43B 13/28
WO 2006/085345 A1 8/2006

OTHER PUBLICATIONS

Kim et al., "Function Shoe Midsole Capable Of Hardness Control" (translation), Jul. 23, 2015, Clarivate Analytics (Year: 2015).*

*Primary Examiner* — Khoa D Huynh
*Assistant Examiner* — Haley A Smith
(74) *Attorney, Agent, or Firm* — Edell, Shapiro & Finnan, LLC

(57) ABSTRACT

A sole structure for an article of footwear includes a midsole, where the midsole includes a cut-out section extending from a top surface of the midsole to a depth within the midsole. A support structure is disposed within the cut-out section, the support structure including a rail structure and a support plate that is movable in a sliding manner along the rail structure in a lengthwise direction of the sole structure. An insert is disposed within the cut-out section above the support structure.

18 Claims, 9 Drawing Sheets

(56) References Cited

U.S. PATENT DOCUMENTS

| | | | | |
|---|---|---|---|---|
| 2004/0250449 | A1* | 12/2004 | Testa | A43B 21/26 36/35 B |
| 2005/0055848 | A1* | 3/2005 | Miller | A43B 1/0072 36/97 |
| 2008/0296871 | A1* | 12/2008 | Hsieh | A63C 1/26 280/607 |
| 2014/0290097 | A1* | 10/2014 | Bann | B29D 35/142 36/102 |
| 2015/0359294 | A1* | 12/2015 | VanHook | A43B 13/04 36/25 R |

* cited by examiner

SOLE STRUCTURE FOR AN ARTICLE OF FOOTWEAR

CROSS-REFERENCE TO RELATED APPLICATION

This application claims priority from U.S. Provisional Patent Application Ser. No. 62/964,880, filed Jan. 23, 2020, the disclosure of which is incorporated herein by reference in its entirety.

FIELD OF THE INVENTION

The present invention relates to an article of footwear and, in particular, to an athletic shoe.

BACKGROUND

An article of footwear is typically designed to provide adequate support and stability for a user's foot for one or more types of activities. For example, the sole structure of an athletic shoe, which typically includes a midsole and an outsole, can be configured differently depending upon a particular type of athletic activity for which the shoe is to be used. For running shoes, greater or enhanced stability may be desired at a central or midfoot region of the shoe (e.g., to provide enhanced arch support for the user's foot). Alternatively, for other athletic shoes, such as shoes used in a gym for resistance training and/or other forms of training, greater or enhanced stability may be desired at another location closer to the rear or heel end of the shoe. For one who is engaged in a variety of different athletic activities, it is often desirable for that person to have two or more different types of shoes for use when engaging in different forms of exercise.

It would be desirable to provide an article of footwear that facilitates enhanced stability for a variety of different types of athletic exercises.

SUMMARY OF THE INVENTION

In certain embodiments, a sole structure for an article of footwear comprises a midsole. The midsole comprises a cut-out section extending from a top surface of the midsole to a depth within the midsole. The sole structure further comprises a support structure disposed within the cut-out section of the midsole, the support structure comprising a rail structure and a support plate that is movable in a sliding manner along the rail structure in a lengthwise direction of the sole structure. In addition, an insert is disposed within the cut-out section above the support structure.

In other embodiments, an article of footwear comprises a sole structure, where the sole structure comprises an upper and a midsole. The midsole comprises a cut-out section, a support structure and an insert as described herein.

The above and still further features and advantages of the present invention will become apparent upon consideration of the following detailed description of specific embodiments thereof.

BRIEF DESCRIPTION OF THE DRAWINGS

Like reference numerals have been used to identify like elements throughout this disclosure.

DETAILED DESCRIPTION

Figure 1:
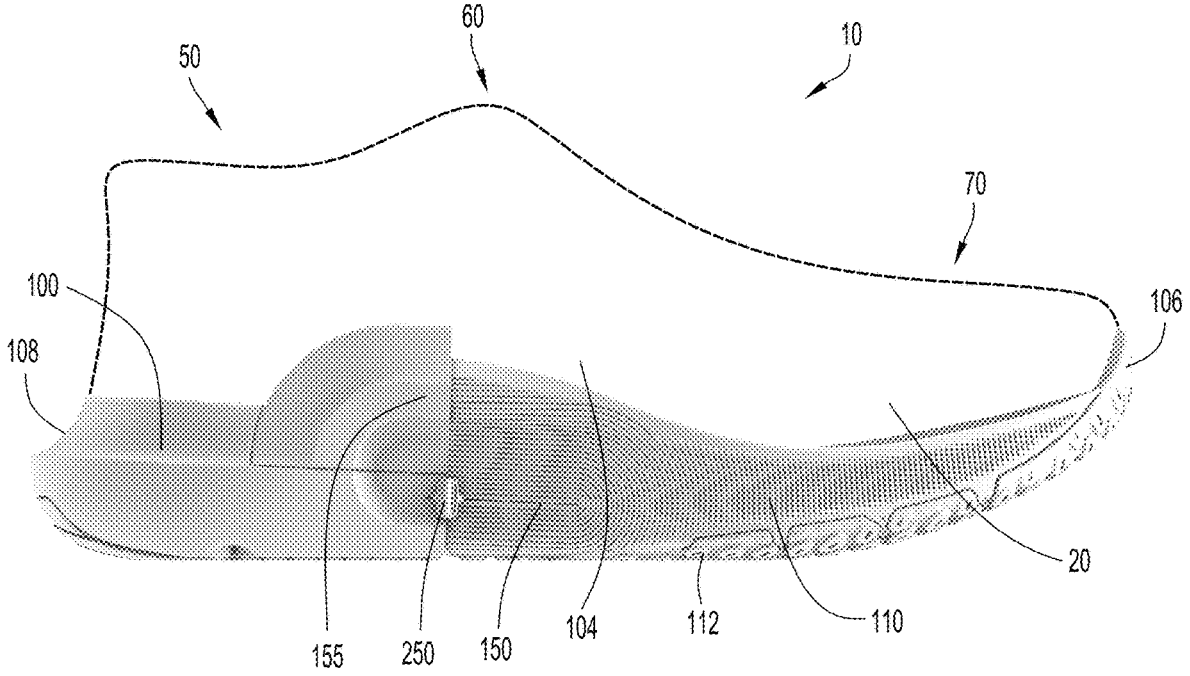
FIG. 1 is a lateral side view of an article of footwear including an upper and a sole structure in accordance with an embodiment of the invention (footwear configured for a right foot).

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

As described herein with reference to the example embodiment of FIGS. 1-7, an article of footwear 10 in accordance with the invention includes an upper 20 coupled with a sole structure 100. The article of footwear 10, also referred to herein as a shoe, can be in the form of an athletic shoe that can be used for any one or more types of athletic activities (e.g., running, weight training, aerobic activities, etc.). The sole structure 100 includes a support structure 200 (provided within a midsole 110 as described herein) with a movable sled or support plate 210 that is selectively adjustable to be moved to various positions along a lengthwise dimension of the sole structure 100 and shoe 10.

The shoe 10 defines several regions corresponding with various parts of a foot. Specifically, the shoe 10 defines a heel region or rear footwear region 50 generally corresponding with the rear or heel portion of the foot (e.g., the hindfoot includes the heel and ankle areas of the foot), an intermediate footwear region 60 disposed forward the rear region and generally corresponding with the midfoot (e.g., the arched, instep, and ball areas of the foot), and a forward footwear region 70 disposed forward of intermediate region and generally corresponding with the forefoot (e.g., the toes of the foot). The upper 20 also includes a cavity to receive and user's foot and may further include a fastener (e.g., a shoe lace) to secure the upper and shoe to the user's foot. The upper 20 can be formed of any suitable one or more materials depending upon the intended use of the shoe. The sole structure 100 (which is described in further detail herein) includes a midsole structure or midsole 110 and an outsole structure or outsole 112 disposed at a bottom surface location of the midsole 110 such that the outsole 112 is configured to engage with the ground surface when the shoe is worn by a user. The midsole 110 includes a plurality of flexure grooves 117 located at the forward footwear region 70 and extending along an upper or top surface 116 of the midsole and also in directions transverse the lengthwise (i.e., toe-to-heel) dimension of the sole structure 100. The flexure grooves 117 are suitably dimensioned, shaped and aligned to permit a suitable amount of flexure of the midsole 110 and sole structure 100 at the forward footwear region 70 during use of the shoe.

The midsole and outsole can also be formed of any one or more suitable materials (as described herein), where the outsole is generally constructed of a material that is harder (i.e., has a greater durometer value when measured on a Shore hardness scale, such as Shore A hardness, Shore C hardness, etc.) and/or less compressible in comparison to the midsole. In example embodiments, the midsole may be formed of one or more materials including, without limitation, ethylene vinyl acetate (EVA), an EVA blended with one or more of an EVA modifier, a polyolefin block copolymer, and a triblock copolymer, and a polyether block amide (e.g., a PEBAX® material). As described in further detail herein, the midsole can be formed of two materials having different hardness or durometer values (e.g., as measured on a Shore C hardness scale using an Asker Durometer and an ASTM D2240 standard).

The outsole can be formed of a harder material in relation to the material that forms the midsole. The outsole may be formed as a single layer or as a plurality of separate layers (e.g., one or more forefoot elements, one or more midsection elements, and one or more heel elements). The outsole can further be formed of one or more materials including, without limitation, elastomers (e.g., thermoplastic polyurethane), siloxanes, natural rubber, and synthetic rubber. In an example embodiment, the outsole (forefoot member and heel pad members) can be formed of the same rubber material, e.g., a rubber material commercially available from Vibram S.p.A. (Italy), and having a durometer of about 67A as measured using a Shore A hardness scale (ASTM 2240 standard). In other embodiments as described herein, different sections of the outsole can also be formed of different materials having different hardness or durometer values. A ground-facing side of the outsole 112 can also include a textured surface and/or include one or more recesses formed therein, such as indentations or grooves which provide a number of enhanced properties for the sole structure 100 (e.g., flexure/pivotal bending along grooves to enhance flexibility of the sole structure during use).

The support structure 200 comprises a contained structure, cartridge or cassette containing components as described herein that facilitate selective variance of the stiffness or support provided by the sole structure during use of the shoe and depending upon a particular exercise or activity associated with use of the shoe. Components of the support structure provided within the midsole can also be formed of different materials having different hardness or durometer values as described in further detail herein.

Referring to FIGS. 1 and 2A-2C, the sole structure 100 includes a medial side 102 (which corresponds with the medial side of the shoe) that is oriented along the medial or big toe side of the user's foot, a lateral side 104 (which corresponds with the lateral side of the shoe) that is oriented along the lateral or little toe side of the user's foot (the medial and lateral sides being distinguished by a central, longitudinal axis), a toe (i.e., front) end 106 that corresponds with the toe end of the user's foot, and a heel (i.e., rear) end 108 that corresponds with the heel of the foot. The sole structure 100 also includes rear, intermediate and forward regions that correspond with the same regions 50, 60, 70 of the shoe 10.

Referring to FIGS. 2C-2F and also FIGS. 3A-3D, the support structure 200 is secured within an opening or cavity within the midsole 110 of the sole structure 100 and includes components that are adjustable along a portion of the length of the midsole. In particular, the support structure 200 includes a support element in the form of a movable plate or sled that can be selectively moved in a lengthwise dimension of the sole structure and shoe 10 (i.e., moved along a dimension that is oriented in a direction between the front end 106 and heel end 108 of the sole structure 100) so as to change or modify a location of a stability feature for the shoe as described herein. The midsole 110 includes a generally rectangular cavity or cut-out section 120 defined at the top surface 116 of the midsole 110. The cut-out section 120 is provided at a location that is situated between and occupies a portion of the rear footwear region 50 and the intermediate footwear region 60. Further, a lengthwise dimension of the cut-out section 120 extends in a direction between the rear and intermediate footwear regions. The cut-out section 120 has a depth that extends from the top surface 116 of the midsole and is less than the thickness of the midsole 110 (i.e., the cut-out section does not extend through the midsole). Located at each lengthwise end of the cut-out section 120 is a stepped portion that defines a ledge 125. Each ledge 125 extends the entire width of the cut-out section, where the ledges 125 extend from a bottom surface of the cut-out section and have a height that is less than the depth of the cut-out section such that each ledge is located a selected depth from the top surface 116 of the midsole 110 to facilitate receipt and support of a midsole insert 160 as described in further detail herein.

Disposed within and extending from the bottom surface of the cut-out section 120 are two raised members 130, also referred to herein as islands 130, where each island 130 extends from a corresponding ledge 125 of the cut-out section 120 and in a direction toward the other island 130, where the islands 130 are distanced from each other to define a gap there between. Each island 130 is centrally located along the cut-out section width and has a width that is less than the width of the cut-out section. Further, each island 130 has a tapered free end 135 that forms a generally convex or V-shaped edge. The free or open portions of the cut-out section (which are defined by the area covering the exposed bottom surface of the cut-out section) generally define an "H" shape surrounding the islands 130.

The various components of the support structure 200 are depicted in FIGS. 2D-2F, 3A-3D, and 4-6. The support structure 200 includes a movable sled or support plate 210 and a rail structure 220, each of which is suitably dimensioned to fit within the cut-out section 120 of the midsole 110. The support structure 200 further includes a midsole cap or insert 160 that also fits within the cut-out section 120 to enclose the support plate 210 and rail structure 220 within the cut-out section 120.

The support plate 210 is movable within the cut-out section 120 and is structurally configured to slide along a rail structure 220 when adjusting the support within the shoe as described herein. Each of the support plate 210 and rail structure 220 can be constructed of any hard plastic or other suitably hard materials that provide a sufficiently stable support structure within the midsole for supporting a foot of the user wearing the shoe. In an example embodiment, the support plate and rail structure can be formed of reinforced nylon, such as a high density polyamide material reinforced with silicon or glass fibers commercially available from Arkema S.A. (France). In a further, non-limiting example embodiment, the support plate and rail structure can be formed of high density polyamide material reinforced with glass fibers and having a high stiffness/high flexural modulus (as measured using an ASTM D790, ISO 178 standard) that is greater than 1000 MPa, such as 1300 MPa or greater, or even 1500 MPa or greater (e.g., a material commercially available from Arkema S.A. under the tradename BZMO7).

The rail structure 220 has a general "H" shape that corresponds with the "H" shape of the open portions of the cut-out section 120 such that the rail structure 220 is fit within the cut-out section between the ledges 125 and islands 130. The rail structure 220 includes two elongated rails 225 and a central connection member 230 that extends transversely between the rails 225, where the rail structure 220 is dimensioned so that the rails 225 extend lengthwise between the ledges 125 at or near the lengthwise edges of the cut-out section 120 while the central connection member 230 fits within the cut-out section between the islands 130. In particular, the central connection member 230 includes opposing edges 235 each of which forms a general concave or V-shape which is complementary to the general convex or V-shape of the tapered free end 135 for a corresponding island 130 that faces the edge 235 when the rail structure 220 is placed within the cut-out section 120.

Figure 3A:
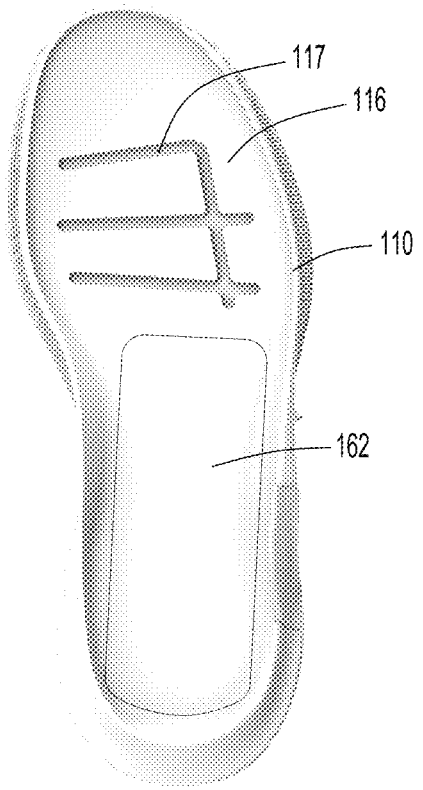
FIG. 3A is a top view in plan of the sole structure of FIG. 1.
Figure 3B:
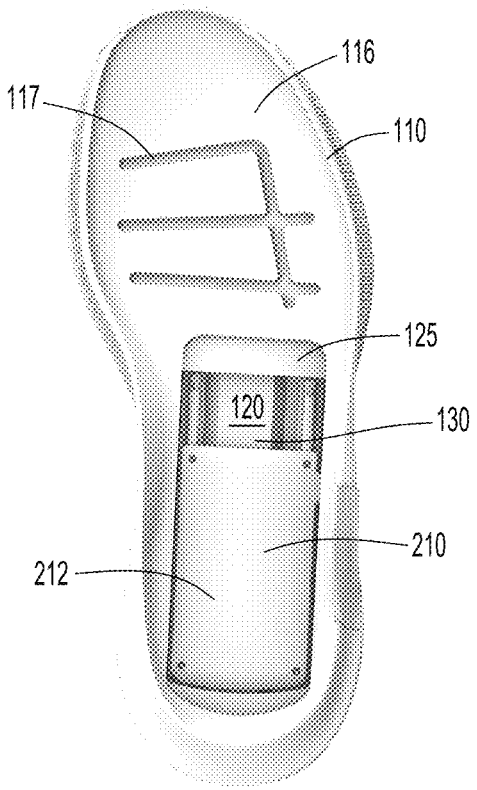
FIG. 3B is a top view in plan of the sole structure of FIG. 3A, with the midsole insert removed to reveal the contents within the cut-out section of the midsole.
Figure 3C:
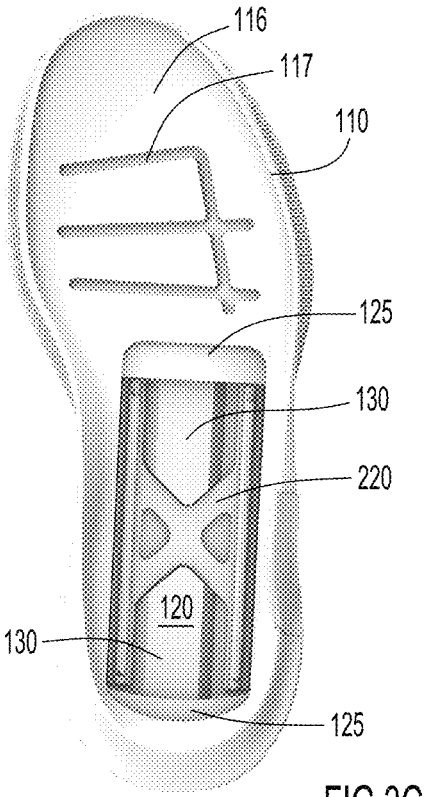
FIG. 3C is a top view in plan of the sole structure of FIG. 3B, with support plate removed from the cut-out section of the midsole.
Figure 3D:
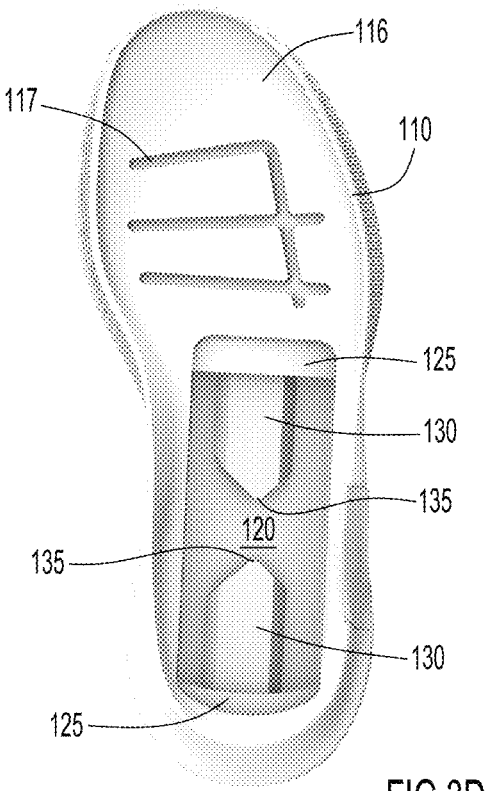
FIG. 3D is a top view in plan of the sole structure of FIG. 3C, with rail structure removed from the cut-out section of the midsole.

As can be seen, e.g., in FIG. 3C, the rail structure 220 fits snugly within the cut-out section 120 between the islands 130 such that it is significantly limited or prevented from moving within the cut-out section 120 once installed. Thus, the dimensions and complementary shapes of the rail structure 220 and the cut-out section 120 including islands 130 permit the rail structure to be installed and maintained in place by simply fitting the rail structure between the islands (and installation of the further components of the support structure within the cut-out section). Alternatively, the rail structure can be further secured, e.g., by adhering lower surface portions of the rail structure to the lower surface of the cut-out section during installation. In addition, the shape of each island 130, including tapered free end 135, within the cut-out section 120 of the midsole 110 facilitates a greater contact area between the islands and portions of the support plate 210 during sliding movements of the support plate while also allowing for a snug fit of the rail structure 220 within the cut-out section 120.

Figure 2A:
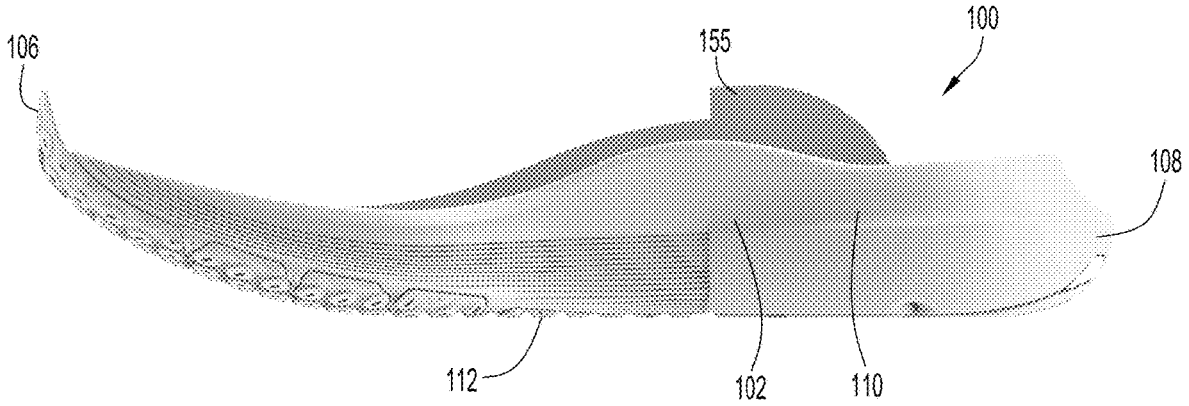
FIG. 2A is a medial side view of the sole structure of FIG. 1.
Figure 2B:
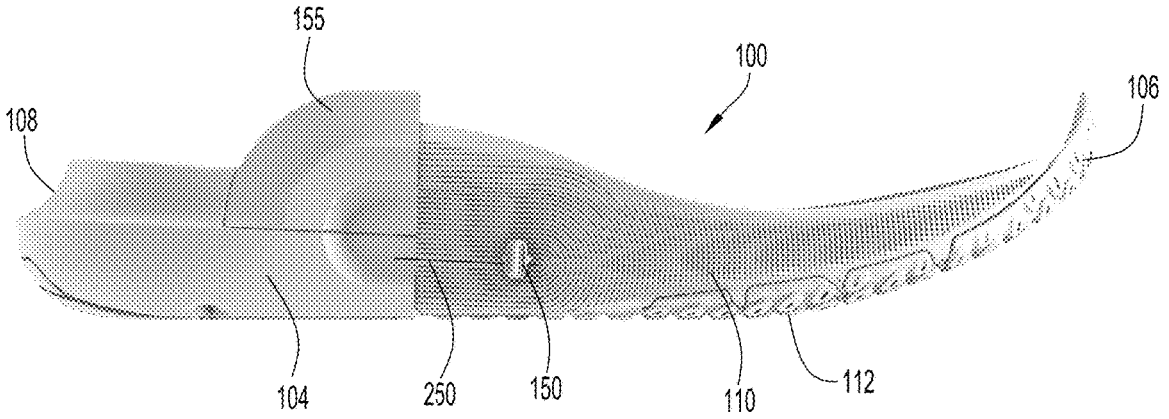
FIG. 2B is a lateral side view of the sole structure of FIG. 1.
Figure 2C:
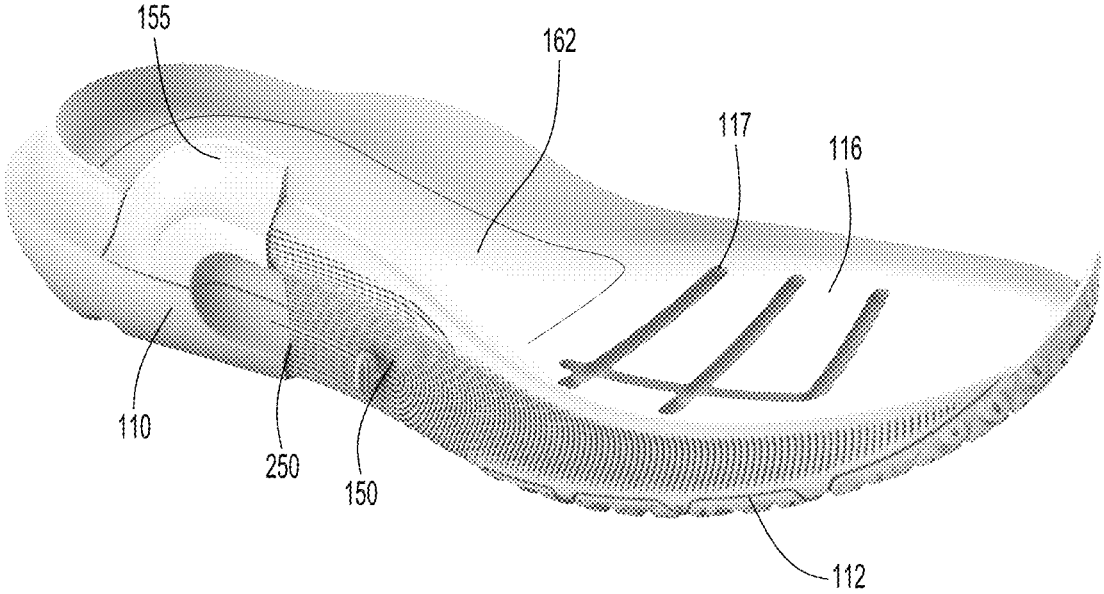
FIG. 2C is a front and lateral side view in perspective of the sole structure of FIG. 1.
Figure 2D:
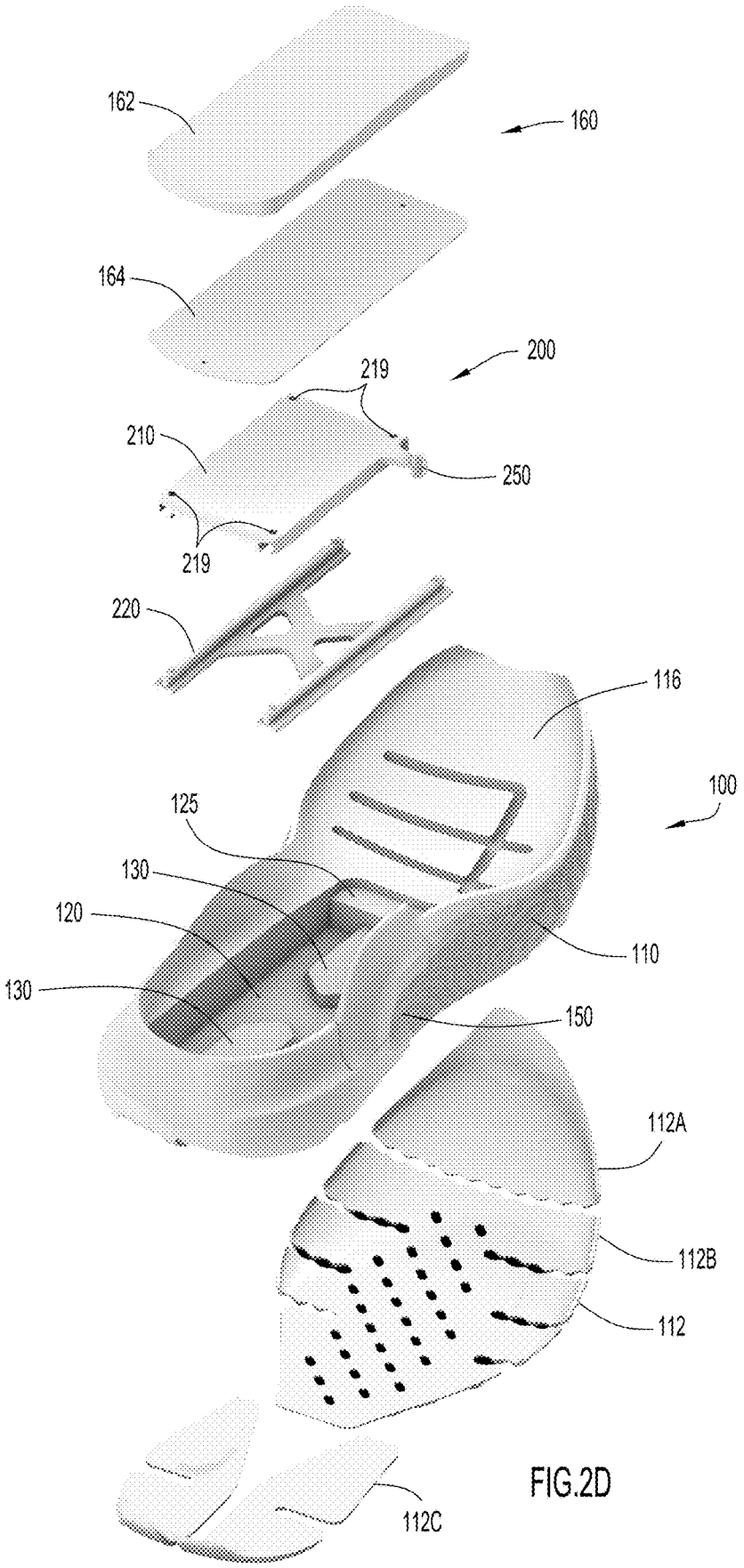
FIG. 2D is a rear and lateral side exploded view in perspective of the sole structure of FIG. 1, showing the support structure provided within the midsole of the sole structure.
Figure 2E:
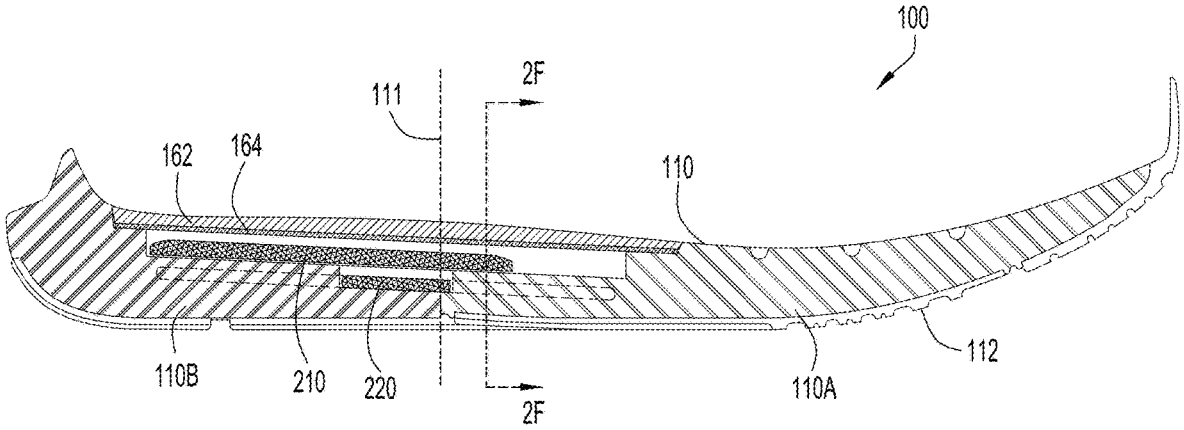
FIG. 2E is a lateral side view in cross-section of the sole structure showing the midsole.
Figure 2F:
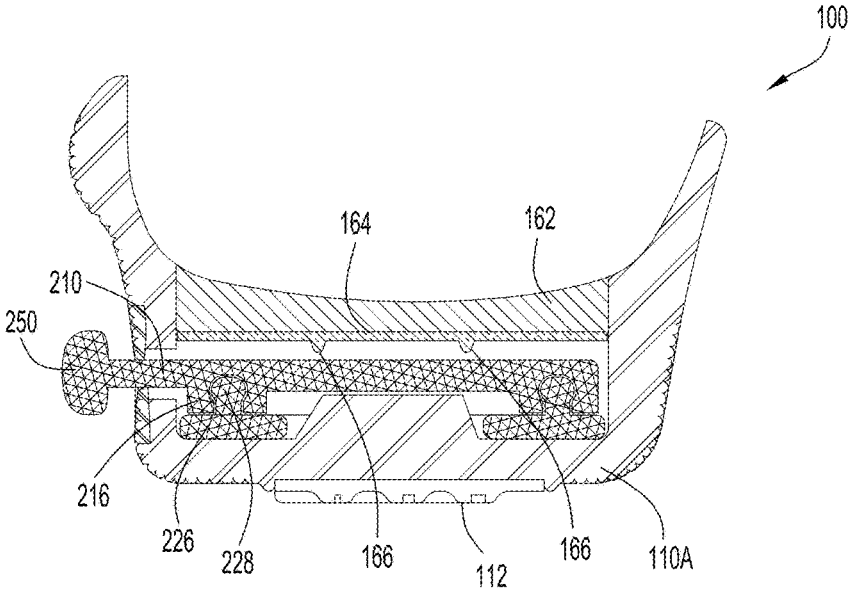
FIG. 2F is a cross-sectional view of the sole structure taken along line 2F-2F as shown in FIG. 2E.
Figure 4:
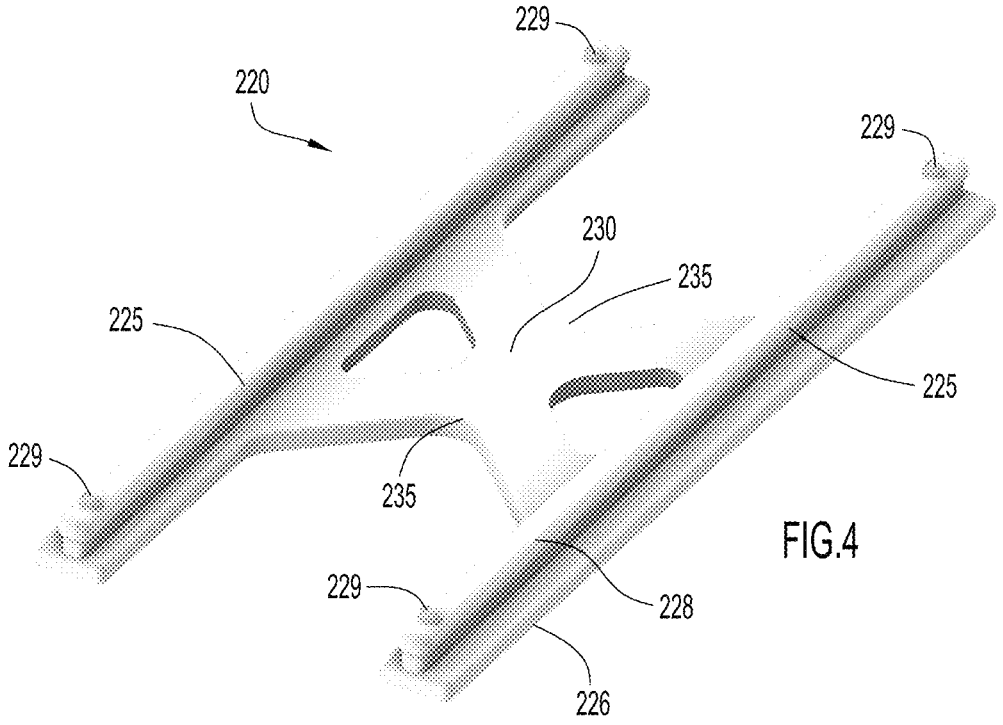
FIG. 4 is a top view in perspective of the rail structure for the support structure provided within the midsole for the sole structure of FIG. 1.

Referring to FIGS. 2F and 4, each rail 225 includes a flat and generally rectangular base 226 and an elongated bulbous or curved member 228 (e.g., having at least a partially cylindrical shape) that extends from the base 226. Disposed at each lengthwise end of each curved member 228 is a bump or protrusion 229 that extends outward and away from a top peripheral surface portion of the curved member. The protrusions 229 provide a locking feature for selectively locking the support plate 210 at different positions along the rails 225 as described herein.

Figure 5:
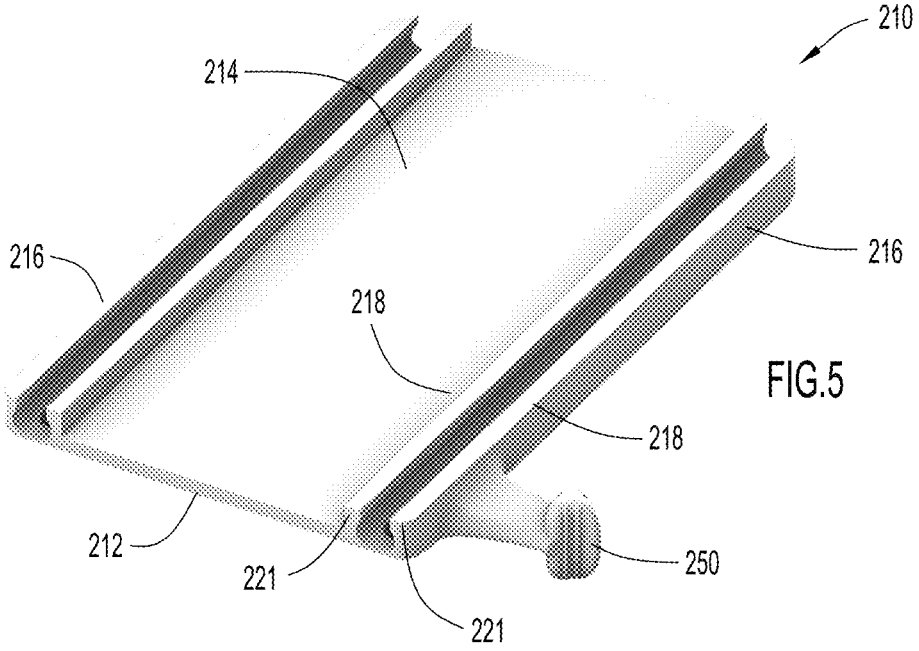
FIG. 5 is a bottom view in perspective of the support plate for the support structure provided within the midsole for the sole structure of FIG. 1.
Figure 6:
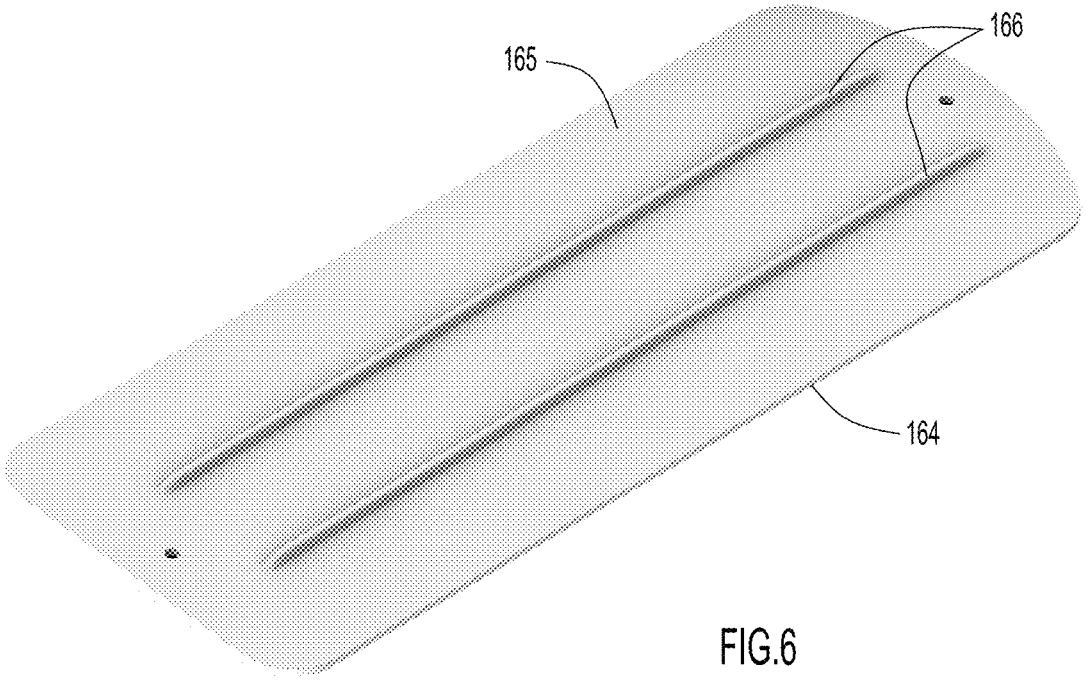
FIG. 6 is a bottom view in perspective of a lower portion of the midsole insert for the sole structure of FIG. 1.

Referring to FIGS. 3B and 5, the movable sled or support plate 210 has a generally rectangular configuration and is dimensioned to fit within the cut-out section and so that its lengthwise ends align with the rails 225 of the rail structure 220. The plate 210 has a generally flat top surface 212 that (when installed within the cut-out section 120) faces toward the top surface 116 of the midsole 110. Disposed at a bottom surface 214 of the support plate 210 are a pair of rail receiving or track members 216. Each track member 216 extends lengthwise along the bottom surface 214 and at or near the lengthwise edges of the support plate 210. Each track member 216 comprises a pair of closely spaced apart walls 218 extending from the bottom surface 214 of the support plate 210 and having an inwardly extending lip 221 at a free or terminal end of the wall 218 that extends toward the lip 221 of the other wall 218. The walls 218 are sufficiently spaced from each other and have interior surface curvatures that complement the curvatures of the elongated members 228 so as to receive and retain the elongated member 228 of a corresponding rail 225 between walls 218 when the support plate 210 is engaged with the rail structure 220. When the elongated member 228 of the corresponding rail 225 is received between the walls 218 of a corresponding track member 216, the facing lips 221 of the walls 218 prevent escape of the rail member 228 from its nested location between the walls 218. The track members 216 are further suitably dimensioned so that the support plate 210 can be slidably moved or slided to selected locations along the elongated members 228 of the rails 225 and in a lengthwise direction of the midsole 110.

The dimensions of the support plate 210 and the rail structure 220 facilitate movements of the support plate 210 along the rail structure 220 within the cut-out section 120 so that at least a main and central portion of the support plate 210 is slightly above and/or frictionally slides against but also easily rides over each island 130 during lengthwise movements of the support plate along the rail structure as described herein. Further, the support plate 210 has a sufficient thickness such that, when it is installed within the cut-out section 120 of the midsole 110, the top surface 212 (or at least a portion thereof) of the support plate 210 is generally flush or coplanar with the top surfaces of the ledges 125. Located at each lengthwise end and at each corner of the rectangular shaped support plate 210 is a generally circular recess or opening 219 that extends through the plate so as to extend to each side 212, 214. The openings 219 are located along the sides 212, 214 of the plate 210 so as to correspond with the protrusions 229 of the rail structure 220 so that, when two openings 219 at a lengthwise end of the plate 210 are aligned over corresponding protrusions 220 of the rail structure 220, the protrusions 229 engage within the openings 219 to provide a combined releasable locking structure (i.e., a complementary and releasable locking structure between support plate and rail structure) that prevents slidable movement of the plate 210 along the rails 225 as described herein. It is noted that, instead of an opening 219 that extends through the entire thickness of the support plate 210, a modified recess can instead be provided at different locations along the support plate, where each recess extends only partially into the support plate bottom surface and is suitably dimensioned to receive and retain a corresponding protrusion 229 of the rail structure 220.

The support plate 210 further includes a tab or lever 250 extending transversely from a lengthwise edge and proximate a lengthwise end of the support plate. An elongated slot 150 is provided that extends through the lateral side 104 of the midsole 110 at a suitable location so as to correspond and communicate with (i.e., provide access to) the cut-out section 120. The slot 150 extends in a lengthwise direction of the midsole 110 and is further suitably aligned with the cut-out section 120 and suitably dimensioned to receive the lever 250 when the support plate 210 is installed within the midsole. The lever 250 also has a sufficient length to extend through the slot and away from the midsole lateral side so as to include a selected portion of the tab that is accessible via the exterior of the midsole (as shown, e.g., in FIGS. 1 and 2B). While the midsole with slot and the support plate with lever are configured such that the lever is accessible via the lateral side of the midsole, the midsole and support structure can also be modified such that the slot and lever are provided at other locations of the midsole (e.g., the medial side of the midsole). As described herein, the lever 250 facilitates selective slidable movement of the support plate 210 along the rails 225 of the rail structure 220 to locking positions in which the protrusions 229 of the rails 225 engage with the openings 219 of the plate 210.

As shown in FIGS. 2C, 2D, 3A and 6, a generally rectangular cap or midsole insert 160 is suitably dimensioned to fit within the cut-out section 120 so as to frictionally engage the side walls of the cut-out section, where the insert 160 also has a suitable thickness to fill the remaining depth or space within the cut-out section between the top surface 116 of the midsole 110 and the top surface 212 of the support plate 210 and top surfaces of the ledges 125. The midsole insert 160 includes a soft or compressible first material layer or first portion 162 that forms an upper portion of the insert 160 so that the exposed top surface of the first portion 162 conforms and is generally flush/coplanar or corresponds with the contour of the midsole top surface 116. The midsole insert 160 also includes a lower second material layer or material portion 164 that is adhered to the first portion 162 and includes a lower surface 165 that faces the support plate 210 and engages with ledges 125 when the insert 160 is installed within the cut-out section 120. The lower surface 165 of the lower second portion 164 includes a pair of elongated ridges 166 spaced from and generally parallel with each other and further extending along the lower surface in the lengthwise direction of the lower second portion. The ridges 166 are suitably dimensioned to engage with the top surface 212 of the support plate when the midsole insert 160 is installed within the cut-out section 120. The ridges 166 further function in a similar manner as skis to minimize frictional surface contact between the lower second portion 164 and the support plate 210 during sliding movements of the support plate during use of the shoe.

As described in further detail herein, the compressible first portion 162 can be constructed of the same or similar materials as the midsole 110 or portions of the midsole (e.g., constructed of EVA). In contrast, the second portion 164 that is adhered to the underside of the first portion 162 can be constructed of a harder material (e.g., having a greater hardness or durometer value) in comparison to the material that forms the first portion 162 (e.g., the second portion 164 can be formed from nylon or a hard polyurethane material). In an example embodiment, the second portion 164 is formed of a thermoplastic polyurethane (TPU) material having a Shore A hardness of at least 60A, or at least 70A, or even 80A or greater (as measured using an ASTM D2240 standard).

The midsole 110 can be formed from two different materials that, while being more compressible (i.e., smaller hardness or smaller durometer value) in relation to the outsole, have different hardness or durometer values in relation to each other. Referring to FIG. 2E, a cross-sectional view taken along the lengthwise dimension of the sole structure 100 shows the midsole 110 being formed as a first or front section 110A and a second or rear section 110B. The front section 110A extends from the front or toe end 106 of the shoe/sole structure to and extends beyond the forward footwear region 70 to the intermediate footwear region 60. The rear section 110B connects with the front section 110A at the intermediate footwear region 60 and along join line 111, where the rear section 110B continues along the rear footwear region 50 to the heel end 108. An injection molding process or any other conventional or other suitable process can be utilized to form a midsole as a unitary or single member formed from two (or more) different materials.

The front and rear sections 110A, 110B of the midsole 110 can be made from materials having a different hardness or durometer value, where the rear section 110B can have a greater hardness or durometer value (i.e., more stiff, less compressible) than the front section 110A. As previously noted herein, the midsole can be formed of two different types of EVA materials having different hardness/durometer values. In an example embodiment, the midsole front section 110A is formed of a first EVA material having a Shore C hardness value (e.g., as measured on a Shore C hardness scale using an Asker Durometer and an ASTM D2240 standard) of between about 50C and about 54C (e.g., about 52C), while the midsole rear section 110B is formed of a second EVA material having a Shore C hardness value of between about 52C and about 56C (e.g., about 54C), such that the midsole front section is softer (more compressible) than the midsole rear section. Thus, the hardness or durometer of the midsole can change in a direction from the toe end to the heel end of the shoe, preferably with the heel end of the midsole having the greatest hardness/durometer value (most stiff, least compressible) while the toe end of the midsole has the lowest hardness/durometer value (least stiff, most compressible). Alternatively, all of the midsole sections can be formed of the same material and/or have the same or similar hardness/durometer value.

The first portion 162 of the midsole insert 160 can also be formed of the second EVA material, thus having a hardness/durometer value that is greater than the midsole front section 110A. Alternatively, the first portion can be formed of an EVA or other material having a different hardness than each of the midsole front and rear sections.

Referring to FIGS. 1, 2B and 2C, the lateral side 104 of the midsole 110 can include an upward extending semi-circular or curved member 155 at the lateral side 104 of the midsole 110 that extends from and also above and beyond adjacent top edge portions of the midsole 110 and at the border 111 between the midsole front and rear sections. The curved member 155 can be a separate component or piece or, alternatively, co-molded as part of the midsole rear portion 110B. The curved member 155 can be formed of the same or similar material as the midsole rear section 110B (and thus having the same or similar hardness/durometer value) or, alternatively, of a different material (e.g., TPU). The curved member 155 is further located along the midsole 100 so as to align at or near an ankle location for a foot of a user wearing the shoe 10. The curved member 155 has a suitable hardness/durometer value to provide additional or enhanced support at the midsole 110 and upper 20 when the shoe 10 is worn by a user.

The slot 150 through which the lever 250 of the support plate 210 extends is located along the lateral side 104 of the midsole front section 110A and also at or just forward the border 111 between the midsole front and rear sections. A thin elastomeric layer (e.g., silicone rubber) can be provided around the slot 150 with a slit in the elastomeric layer aligned with the slot 15. The elastomeric layer with slit functions as a gasket to permit extension of the end of the lever 250 through the slit and slot 150 while elastically conforming around the lever 250 and sealing the slot so as to significantly minimize or prevent debris (e.g., dust, dirt, stones or other small foreign objects) from inadvertently entering the cut-out section 120 through the slot 250.

Referring to FIG. 2D, the outsole 112 includes a plurality of separated outsole segments or outsole sections, including a first section 112A located at the forward footwear region 70 at or near the midsole front end 106, a second section 112B extending between the forward footwear region 70 and the rear footwear region 50 and extending the intermediate footwear region 60, and a third section 112C located at the rear footwear region 50 at or near the rear or heel end 108. Similar to the midsole sections, the outsole sections can also be formed of different materials and/or have different hardness/durometer values. For example, the outsole sections closer to the heel end 108 of the midsole (e.g., third section 112C and/or second section 112B) can have a hardness or durometer value that is greater than the hardness or durometer value of sections closer to the toe end 106 (e.g., first section 112A). Thus, the hardness or durometer of the outsole can change in a direction from the toe end to the heel end of the shoe, preferably with the heel end of the outsole having the greatest hardness/durometer value (most stiff, least compressible) while the toe end of the outsole has the lowest hardness/durometer value (least stiff, most compressible). Alternatively, all of the outsole sections can be formed of the same material and/or have the same or similar hardness/durometer value.

Assembly of the support structure 200 within the midsole 110 can be achieved in the following manner. The support plate 210 can first be aligned at one lengthwise end with a lengthwise end of the rail structure 220 so that the each track member 216 aligns with a corresponding rail 225, where the elongated curved member 228 of each rail 225 is inserted between the support plate walls 218 of a corresponding track member 216. The support plate 210 can then be moved in a sliding manner in relation to the support structure 200 so that the rails 225 are engaged with the track members 216 and the support plate is movably coupled with the rail structure 220. The rail structure 220 with its coupled support plate 210 is oriented with the support plate being above the rail structure 220 and the support plate lever 250 facing toward the lateral side 104 of midsole 110 and sole structure 100, and the support structure is then inserted into the cut-out section 120 with the lever 205 being inserted and extending through the slot 150 of the midsole. A lower side of the rail structure 220 can be adhered to the lower surface within the cut-out section 110 between the islands 130. After this assembly step, the support plate 210 rests within the cut-out section 120 and is movable in a sliding manner along the rails 225 and over (e.g., freely and frictionally engaging) the islands 130 and between the ledges 125. The ledges 125 limit the lengthwise sliding movement of the support plate 210 within the cut-out section 120, and the combination of openings 219 in the plate 210 and protrusions 229 of the rails 225 provide locking features for the plate against the rail as described herein. The lever 250, which extends from the midsole lateral side 104 and is exposed, can be gripped by a user (e.g., between the thumb and forefinger of the user) and moved within the slot 150 to facilitate sliding and lengthwise movement of the support plate 210 along the rails 225 and within the cut-out section 120. The midsole insert 160 is then placed within the remaining gap/depth of the cut-out section 120, with the first portion 162 oriented above the second portion 164, so as to engage with and reside over the support plate 210 and ledges 125 (where the ridges 166 of the second portion 164 engage the top surface 212 of the support plate 210).

During use, the user can move the support plate 210 to various positions within the cut-out section 120 along a lengthwise dimension of the midsole 110, where such movement is achieved by the user moving the lever 250 along slot 150. Such movement of the support plate 210 within the midsole 110 can be achieved while the user is wearing the shoe 10 or, alternatively, when the shoe 2 is not being worn. Movement of the support plate 210 within the midsole 110 facilitates changing a location of enhanced structural support and/or stability along the lengthwise direction of the shoe 10. This allows the shoe to be used for a variety of athletic and/or exercise activities in which it may be desired to increase and/or enhance structural support/stability at different specific locations of the midsole in relation to a user's foot depending upon the specific activity.

Figure 7A:
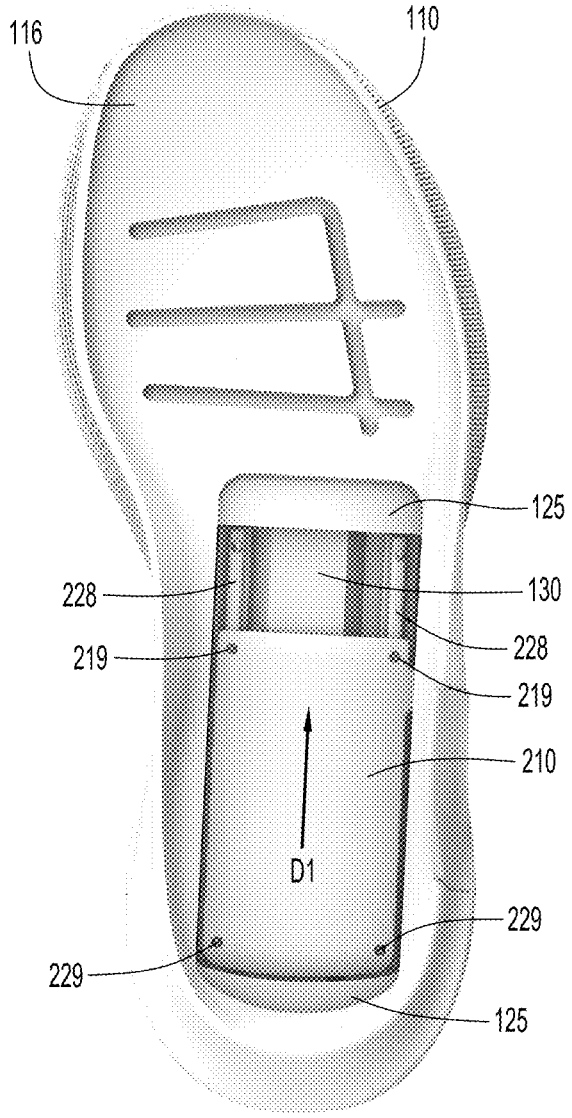
FIGS. 7A and 7B are top views in plan of the sole structure of FIG. 3B, showing movements of the support plate along the rail structure within the cut-out section of the midsole.
Figure 7B:
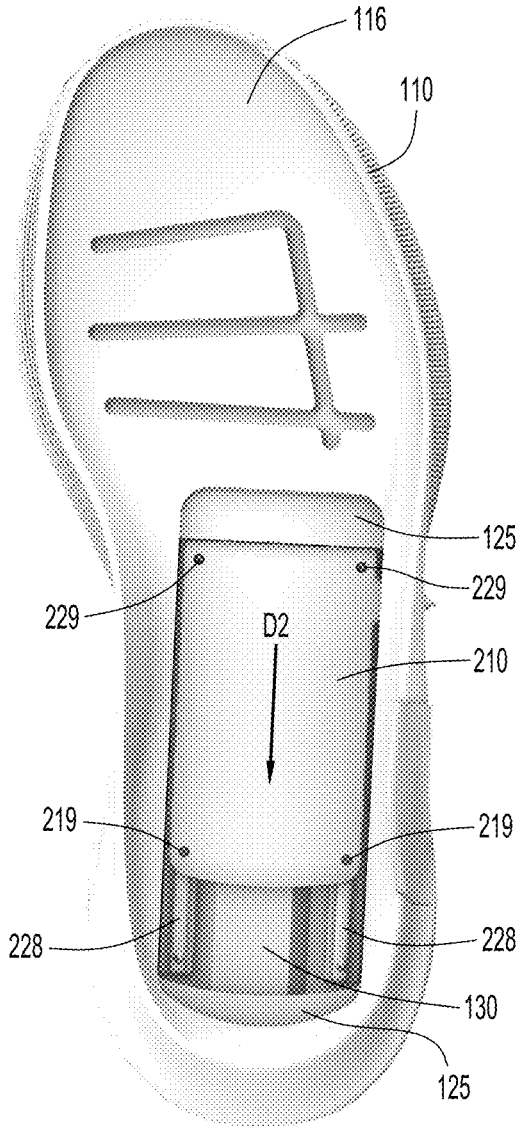

Referring to FIGS. 7A and 7B, some examples of locations to which the support plate 210 can be moved within the midsole 110 are depicted. In FIG. 7A, the support plate 210 is disposed at a first location which is at its furthest rearward position within the cut-out section 120 toward the heel end 108 of the midsole 110. In this position, the support plate 210 lies over and engages with the island 130 located at or near the rear footwear region 50 and closest to the midsole heel end 108, and the plate 210 is also locked in relation to the rails 225 (i.e., limited or prevented from moving without user actuated movement caused by sliding the lever 250 within the slot 150) since openings 219 at the end of the plate 210 engage with corresponding protrusions 229 of the rails 225 (i.e., the protrusions 229 are lodged within the openings 219). In this locked position, the support plate 210 provides a less compressible, more hard and solid surface at the heel end of the shoe so as to increase and/or enhance structural support and/or stability under the user's heel during use of the shoe. This can be beneficial for certain types of athletic activities and/or exercises (e.g., in activities involving certain static exercises such as squatting, deadlifting or other weight lifting activities by the user). In further embodiments in which the midsole and/or outsole has the greatest hardness/durometer value at or near the heel end, the combination of the support plate location with the increase in hardness at the heel can provide further enhanced hardness, support and stability at the heel end of the shoe for such activities.

The support plate 210 can be released from its locked position as shown in FIG. 7A and moved from the first location within the midsole 110 by a user pushing or pulling the lever 250 within the slot 150 toward the front end 106 (as indicated by arrow D1 in FIG. 7A). The lever 250 can be moved to its furthest forward position in the slot 150 so that the plate is situated at a second location within the midsole as shown in FIG. 7B. At this second location, the support plate 210 lies over and engages with the island 130 located at or near the intermediate footwear region 60 (i.e., at a location at or near the arch of a user's foot) of the midsole 110. The support plate 210 is also at the furthest forward position within the cut-out section 120 toward the midsole front end 106 and is also locked in this position (i.e., limited or prevented from moving without user actuated movement caused by sliding the lever 250 within the slot 150) due to the engagement of the openings 219 and protrusions 229 at the corresponding ends of the plate 210 and the rails 225. Providing the support plate at this second position can be beneficial for enhancing structural support and/or stability at the midfoot are of the user's foot, e.g., providing enhanced arch support for certain athletic activities and/or exercises (e.g., for running, jumping, etc.).

At each of the first and second locations of the support plate (as shown in FIGS. 7A and 7B), the combination of the islands 130 engaging with the support plate 210 provides adequate support and stability for the user's foot during use of the shoe. The support plate can be unlocked and moved from the second position back to the first position by moving lever 250 toward the heel end 108 (as shown by arrow D2 in FIG. 7B).

The support plate is not limited to being oriented in the first and second locations/locked positions but can also be moved to any selected location between such furthest rearward and forward locations based upon user preference for a particular activity. For example, a user may find that orienting the support plate 210 within the cut-out section 120 at a general midpoint between the first and second locations provides the most beneficial support and stability for the user's foot for a specific activity. In addition, further locked positions can be formed for the support plate by adding further openings in the support plate and corresponding protrusions along the rails to lock the support plate at intermediate locations between the first and second positions as shown in FIGS. 7A and 7B. At certain locations within the cut-out section 120, the support plate 210 may have lower surface area portions that do not overly either island 130. However, since the midsole insert 160 includes the hard second portion 164 (e.g., a nylon second portion) underlying the compressible first portion 162, this second portion provides further structural support for the user's foot at locations where the support plate 210 includes a portion that lies between the two islands 130.

Thus, the present invention facilitates modification and adjustment of structural support and/or stability within the midsole of a shoe along the lengthwise dimension of the midsole and shoe, where the user can selectively adjust a location of increased or enhanced structural support within the midsole by simple movement of an adjustment lever located exterior to the shoe. This adjustment feature further allows the user to make an adjustment during use of the shoe (e.g., while wearing the shoe). In other words, the user does not need to take off the shoe in order to make support/stability adjustments for the shoe by lengthwise movements of the support plate 210 toward or away from the toe end or the heel end.

While the invention has been described in detail and with reference to specific embodiments thereof, it will be apparent to one skilled in the art that various changes and modifications can be made therein without departing from the spirit and scope thereof. For example, while the example embodiments depicted in the figures show an article of footwear (shoe) configured for a right foot, it is noted that the same or similar features can also be provided for an article of footwear (shoe) configured for a left foot (where such features of the left footed shoe are reflection or "mirror image" symmetrical in relation to the right footed shoe).

The upper 20 can be formed of any one or more materials suitable for its described purpose, including conventional materials (e.g., woven or nonwoven textiles, knit textiles, leather, synthetic leather, rubber, etc.). The specific materials utilized to form the upper are generally selected to impart wear-resistance, flexibility, air-permeability, moisture control and/or comfort to the user wearing the shoe 10.

The midsole, outsole and support structure components can be constructed of any suitable one or more materials such as the types described herein. In addition, the midsole and support plate can be modified in any suitable manner such that the lever extending from the support plate is exposed at any one or more locations along the midsole (e.g., along the lateral side of the midsole, along the medial side of the midsole, along a bottom surface of the sole structure in which the support plate lever extends through the midsole and/or the outsole, etc.).

Each of the midsole and the outsole can further be formed of a single, unitary member or, alternatively any selected number of segmented members. The hardness/durometer values for each of the midsole and the outsole can vary in any suitable manner along the length or toe-to-heel dimension of the sole structure.

The support structure including movable sled or support plate and rail structure can have any suitable configurations that permit sliding movement of the support plate along rails of the rail structure. In addition, any suitable locking mechanism can be provided to facilitate a releasable locking connection between support plate and the rails of the rail structure at any suitable one or more locations along the rails.

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

What is claimed:

1. A sole structure for an article of footwear, the sole structure comprising:

a midsole including a cut-out section extending from a top surface of the midsole to a depth within the midsole;

a support structure disposed within the cut-out section, the support structure comprising:

a rail structure and a support plate that is movable in a sliding manner along the rail structure in a lengthwise direction of the sole structure;

an insert disposed within the cut-out section above the support structure; and a lever that is coupled with the support plate and is movable in a lengthwise direction of the sole structure so as to facilitate sliding movement of the support plate along the rail structure;

wherein the midsole includes an elongated slot extending through a side of the midsole and in the lengthwise direction of the sole structure, the lever extends through the elongated slot so as to be accessible from an exterior of the midsole, and the support plate is movable along the rail structure in response to movement of the lever within the slot.

2. The sole structure of claim 1, wherein the midsole includes two islands extending from a bottom surface of the cut-out section within the midsole, wherein each island extends from a lengthwise end of the cut-out section toward the other island and to a terminal end such that a gap exists between the terminal ends of the islands.

3. The sole structure of claim 2, wherein the support plate is movable within the cut-out section to overlie portions of each island.

4. The sole structure of claim 2, wherein the rail structure comprises a pair of rails, and the support plate includes a pair of track members, each track member including walls spaced apart from each other to receive a corresponding rail of the rail structure so as to facilitate sliding movement of the support plate along the rails.

5. The sole structure of claim 4, wherein the rail structure further comprises a central connection member that extends between and connects the pair of rails, the central connection member includes opposing edges, each opposing edge of the central connection member has a concave edge that corresponds with a tapered end of an island that faces the concave edge.

6. The sole structure of claim 4, wherein the rails and the support plate include complementary locking structure that facilitates locking of the support plate in relation to the rail structure at a selected location along the rails.

7. The sole structure of claim 6, wherein the complementary locking structure comprises an opening on the support plate and a protrusion on at least one rail that is located along the rail so as to correspond and engage with the opening when the support plate moves along the rails.

8. The sole structure of claim 1, wherein the insert comprises a first material layer and a second material layer adhered to an underside of the first material layer, the second material layer has a hardness that is greater than the first material layer, and at least a portion of a top surface of the first material layer is coplanar with a top surface of the midsole.

9. The sole structure of claim 8, wherein the second material layer includes an elongated ridge extending in a lengthwise direction along a lower surface of the second material layer and facing toward the support plate.

10. The sole structure of claim 1, wherein the midsole has a hardness that varies in a lengthwise dimension of the midsole.

11. The sole structure of claim 1, wherein the midsole comprises a first section that extends to a toe end of the sole structure and a second section that extends to a heel end of the sole structure, and the second section has a hardness that is greater than a hardness of the first section.

12. The sole structure of claim 1, further comprising an outsole including a plurality of separated outsole segments secured along a lower surface of the midsole.

13. The sole structure of claim 12, wherein the outsole segments differ in hardness.

14. The sole structure of claim 12, wherein a first outsole segment is located closer to a heel end of the sole structure than a second outsole segment, and the first outsole segment has a greater hardness than a hardness of the second outsole segment.

15. An article of footwear comprising an upper and the sole structure of claim 1.

16. A sole structure for an article of footwear, the sole structure comprising:

a midsole;

a support structure disposed within the midsole, the support structure comprising a rail and a support plate that is movable in a sliding manner along the rail between a first position in which the support plate is located within the midsole at a heel region including a heel end of the sole structure and a second position in which the support plate is located within the midsole at a midfoot region of the sole structure that is further in distance from the heel end than the first position; and a lever that is coupled with the support plate and is movable in lengthwise direction of the sole structure so as to facilitate sliding movement of the support plate along the rail structure;

wherein the midsole includes an elongated slot extending through a side of the midsole and in the linear direction between the toe end and the heel end of the sole structure, the lever extends through the elongated slot so as to be accessible from an exterior of the midsole, and the support plate is movable along the rail structure in response to movement of the lever within the slot.

17. A sole structure for an article of footwear, the sole structure comprising:

a midsole, the midsole including a cavity open to a top surface of the midsole, wherein the midsole includes two islands extending from a bottom surface of the cut-out section within the midsole, each island extends from a lengthwise end of the cut-out section toward the other island and to a terminal end such that a gap exists between the terminal ends of the islands, and open portions of the cut-out section that surround the two islands combine to define an H shape;

a rail structure disposed within the cavity, the rail structure comprising a pair of rails and a central connection member that extends between and couples at central locations with each rail such that the rail structure has an H shape that corresponds with the H shape defined by the open portions of the cut-out section that surround the two islands; and a support plate that is slidable along the rails within the cavity of the midsole in a lengthwise direction of the sole structure.

18. The sole structure of claim 17, further comprising a lever that couples with the rail structure and is movable in a lengthwise direction of the sole structure to facilitate sliding movement of the support plate along the rails.

* * * * *